US006275154B1

(12) United States Patent
Bennett et al.

(10) Patent No.: US 6,275,154 B1
(45) Date of Patent: Aug. 14, 2001

(54) AUTOMATIC REMOTE MAIL ALTERING SYSTEM

(76) Inventors: Ronald J. Bennett, 213 Moonlight Bay Dr., Panama City Beach, FL (US) 32407; Everett B. James, Jr., 2206 W. 11th St., Panama City, FL (US) 32401

( * ) Notice: Subject to any disclaimer, the term of this patent is extended or adjusted under 35 U.S.C. 154(b) by 0 days.

(21) Appl. No.: 09/536,440

(22) Filed: Mar. 28, 2000

(51) Int. Cl.[7] ..... G08B 13/14
(52) U.S. Cl. ..... 340/569; 340/570
(58) Field of Search ..... 340/569, 557, 340/570, 572.4

(56) References Cited

U.S. PATENT DOCUMENTS

| | | | | |
|---|---|---|---|---|
| D. 335,747 | | 5/1993 | Dearing . | |
| 4,101,877 | | 7/1978 | Rush . | |
| 4,242,670 | * | 12/1980 | Smith | 340/568 |
| 4,363,439 | | 12/1982 | Manian . | |
| 4,633,236 | * | 12/1986 | Buhl | 340/569 |
| 4,794,377 | * | 12/1988 | Benages | 340/569 |
| 4,868,543 | | 9/1989 | Binkley . | |
| 4,999,612 | | 3/1991 | Cherzeny . | |
| 5,023,595 | | 6/1991 | Bennett . | |
| 5,060,854 | * | 10/1991 | Armstrong | 232/37 |
| 5,255,843 | | 10/1993 | Deakyne . | |
| 5,377,906 | * | 1/1995 | Mason | 232/34 |
| 5,382,945 | | 1/1995 | Novak . | |
| 5,664,728 | | 9/1997 | Jones . | |
| 5,861,805 | * | 1/1999 | Reeves | 340/539 |

* cited by examiner

*Primary Examiner*—Jeffery Hofsass
*Assistant Examiner*—Son Tang
(74) *Attorney, Agent, or Firm*—William B. Noll

(57) ABSTRACT

A communication system for detecting mail at remotely located mail receptacles, where the receptacle mounts a battery powered, intermittently operable radio transceiver. The transceiver preferably includes a pair of infrared light beams and a beam reflective membrane, where a reflected beam, i.e. reads itself or other beam, indicates no-mail, whereas an interrupted beam causes a signal to be generated to indicate the presence of mail. The signal is picked up by a radio frequency polling transceiver relay, which in turn relays the signal to one or more, fixed or mobile, radio transceivers.

9 Claims, 3 Drawing Sheets

AUTOMATIC REMOTE MAIL ALTERING SYSTEM

RELATED APPLICATION

This application, directed to a remote mail alerting system, which relies upon an interrupted laser light as the mail detection mechanism, is related to co-pending application, Ser. No. 09/253,366, now U.S. Pat. No. 6,114,959, granted Sep. 5, 2000, by one of the inventors hereof, where the latter system for detecting mail at a remote location is by a weight sensitive mechanism.

FIELD OF THE INVENTION

This invention is directed to the field of mail alerting systems for residential and commercial uses, to advise users thereof at a remote location that mail has been delivered to one's mailbox.

BACKGROUND OF THE INVENTION

The present invention relates to an effective, yet low cost remote system for alerting a user of the system to the delivery of mail to a specified mail receptacle, such as a mail box. The system has particular utility to apartment, condo dwellers, or to any user where the mailbox is centralized for a shared group of users, or is quite remote from the residence.

The prior art offers various remote detection systems, as reflected in the following U.S. Patents, but none offer the simplicity, effectiveness, and low cost of this invention:

a.) U.S. Pat. No. 5,664,728, to Jones, teaches an automatic signal attachment for a security mail box which indicates when the mail box door is opened by activating an alarm. A magnetic release on the door and a pivoting platform within the mailbox triggers the alarm. The mail box allows users access from within a secured location and indicates delivery of the mail at a remote location.

b.) U.S. Pat. No. 5,382,945, to Novak, is directed to an alarm apparatus that immediately alerts mail recipients of postal deliveries made through a mail slot opening. The device is mounted adjacent the mail slot and has an activation lever, the distal end of which is in contact with the hinged, swinging door of the mail slot, and the proximal end of which has a contact switch retention means. As the door is opened, the activation lever rotates causing the retention means to release the contact switch resulting in the completion of a circuit and the sounding of an alarm.

c.) U.S. Pat. No. 5,255,843, to Deakyne, relates to an alarm housing mounted to an exterior side wall surface of an associated rural or house mounted mailbox. The system includes a switch arm having a roller cylinder mounted at a distal end thereof in engagement with the door portion of a rural mailbox, whereupon pivoting of the rural mailbox door to an opened orientation displaces the roller effecting closure of a switch within the alarm housing to activate visual and audible alarm structure.

d.) U.S. Pat. No. 5,023,595, to Bennett, teaches a remote solar powered radio frequency transmitter assembly and radio receiving and signaling system to indicate delivery of mail. The transmitter means is powered by a rechargeable battery system which is normally recharged by solar cells located on the transmitter means housing. The transmitter means comprises an FM radio transmitter operating in the 49 Mhz band, with a signal strength sufficient for providing an alarm signal to receive at least 4,200 feet distant over unbroken terrain. Upon opening of the mailbox door approximately 30 degrees, a switch initiates a six (6) second operation of the transmitter means. A receiver is provided to detect the radiated signal, and to energize visual and audible signals in response thereto. Ten position DIP switches are provided at both transmitter means and receiver to vary the frequency of operation so as to minimize or eliminate interfering signals. The transmitter means is secured to the mailbox by a single attachment post. A jack plug and flexible cord are provided to connect the transmitter means and the switch. The switch is provided with a flat backing plate having a double sided adhesive for ease of installation. The audible alarm at the receiver comprises a digitally generated musical tune.

e.) U.S. Pat. No. 4,999,612, to Cherveny, relates to a wired mail delivery indicator having a physical construction which forces any size of mail across a groove. Slope on the left vertical wall of mailbox slope of panel, and force of gravity cause mail to block a light beam. The light beam is generated by a photodiode emitter and detected by a photo detector. Mailbox and electronic circuitry contains photodiode emitter, photo detector, current limiting resistor and current amplifier transistors. House and electronic circuitry contains power transformer, diode rectifier, and current sensor. House/mailbox connecting wire carries power and mail delivery information with two wires.

f.) U.S. Pat. No. 4,363,439, to Manian, is directed to a mail delivery signal device for detached, rural-type mailboxes wherein an elongated signal arm member, swingably secured along its lower end to a lower front portion of the mailbox so as to lean abuttingly there-against at its upper end, falls arcuately downwardly to project beyond the bottom or either side of the mailbox, selectively, upon the door being opened for the delivery of mail, thereby automatically notifying the recipient that mail has been delivered.

g.) U.S. Pat. No. 4,868,543, to Binkley, teaches a remote mailbox alarm system comprising a mailbox unit and a house module. The mailbox unit comprises a position-sensitive door switch which activates timer circuit, a mail sensing circuit, and a transmitter located on an insert board insertable inside the mailbox. When activated, the mail sensing circuit energizes a light-emitting diode to emit infrared light waves that reflect off mail placed inside the mailbox and onto phototransitor, which thereby causes the transmitter switch to energize. When the door switch is opened, the timer circuit allows the transmitter to continue transmitting for a predetermined period of time. Signals from the transmitter are received by receiver circuit which activates a speaker and a lamp. When the timer circuit times out, the speaker is deactivated while the lamp continues lit until energized by the pushing of reset switch.

h.) U.S. Pat. No. 4,101,877, to Rush, is directed to a system for activating a light and music box in the home when mail is deposited in a mail box located outside the home, and for deactivating the light and music box when the mail is removed. Switch means is provided inside the mail box and a circuit is arranged to activate the signal devices every other time the switch means is closed. Additionally, a signal light is provided on the mail box to enable a visitor to find the proper home at night, and an electrically operated lock is provided for the mail box to prevent the mail from being stolen.

i.) U.S. Pat. No. D-335,747, to Dearing et al., is a design patent illustrating a mail deliver indicator and holder.

The above prior art describes and illustrates various complex systems for sending an alarm or notice to a user of the mailbox that mail has been delivered to the mailbox. The present invention offers a simpler, yet more effective approach to alert such users. The manner by which this approach is realized will become apparent from a reading of the following specification, particularly when read in conjunction with the accompanying drawings.

SUMMARY OF THE INVENTION

The present invention is directed to a communication system for the detection of mail delivered to a remote, closed mail receptacle, where the receptacle, i.e. mailbox, is accessible to the user and other authorized persons. The receptacle includes at least a pair of opposing walls, such as top and bottom, with means mounted in the receptacle for detecting the presense of mail. The improved feature hereof comprises a portable battery, intermittantly operable, radio transceiver mounted on one of the walls, top, for example, and includes at least one infrared light beam directed toward the bottom. The bottom is provided with a beam reflector membrane, whereby the reflected beam from the membrane, if read by the beam source, represents a "no-mail" mode, and an interrupted beam, such as interposed mail, represents a "mail-present" mode. In communication with the intermittantly operable, radio transceiver is a powered, radio frequency polling transceiver relay. The radio transceiver is programmed with an individual code specific to the intermittantly operable, radio transceiver. This retains the privacy of the user's mailbox. Further, memory means are provided in the radio frequency polling transceiver relay to store the receipt of the transmitted signal, based on the individual code, from the intermittantly operable, radio transceiver. Since this radio transceiver is battery powered, the intermittant operation and stored memory will help to extend the life of the radio transceiver. Finally, at least one radio transceiver is provided. These can be at a fixed location, such as house or apartment, or a mobile location, such as a pager, cell phone, or automobile. In each case, the radio transceiver reads the individual code through the polling transceiver relay. By this arrangement, delivered mail to the receptacle is readily detected without the need to make a needless stop at the mailbox.

Accordingly, an object of this invention is to provide an effective, low cost system to alert users thereof to the delivery of mail to the user's mail receptacle, such as a mailbox.

Another object hereof is the provision of a radio transmission system that quickly alerts the user of delivered mail to a selected and protected mailbox.

A further object of this invention lies in the use of multiple radio transceivers, whether fixed or mobile, that gives the user the easy choice of ascertaining the presense of mail when at home or on the move.

These and other objects of the invention will become more apparent to those skilled in the art from the description which follows.

DETAILED DESCRIPTION OF THE PREFERRED EMBODIMENT

Figure 1:
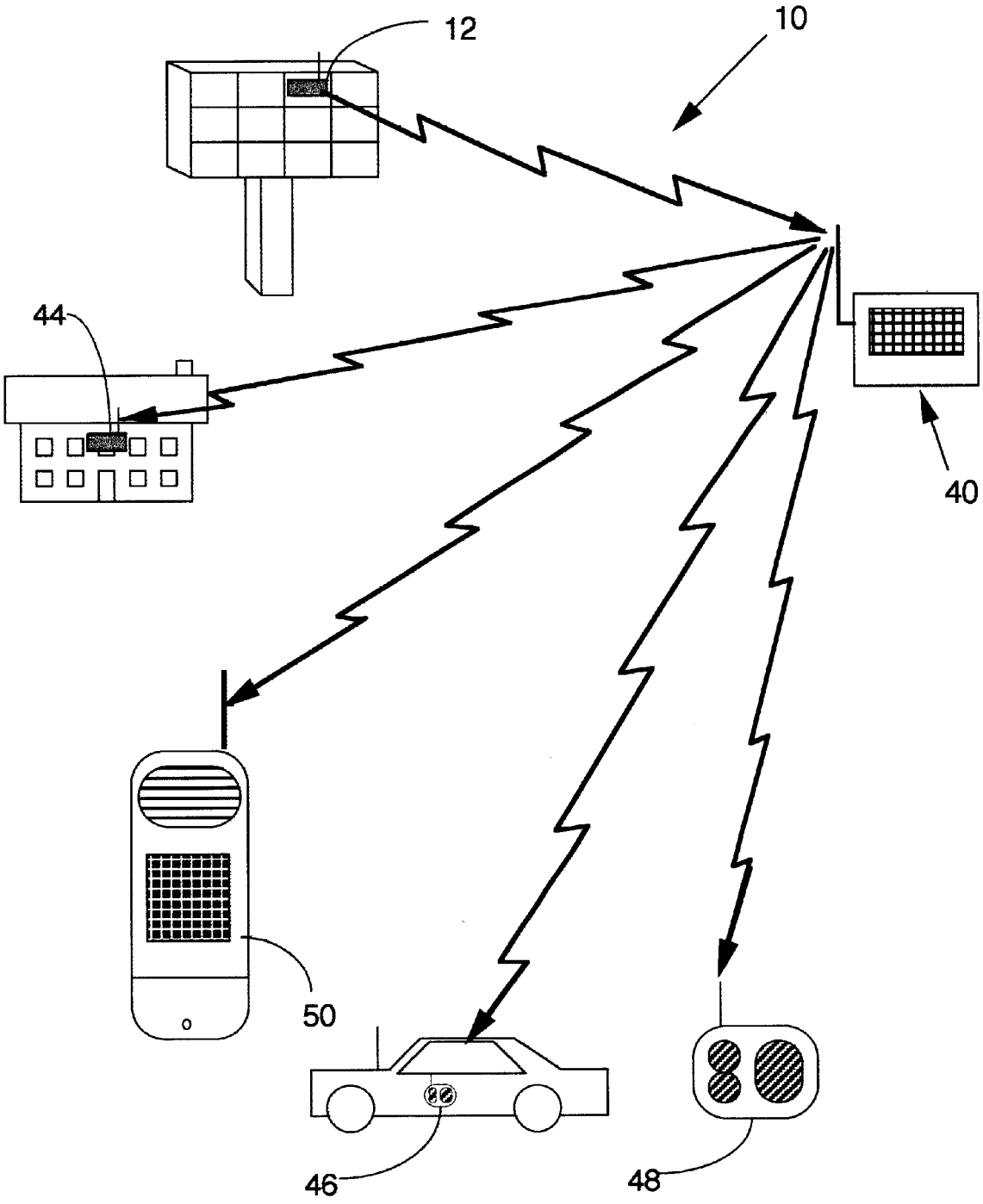
FIG. 1 is a schematic representation of the system pictorially illustrating the remote mail alerting system of this invention.

This invention relates to an automatic, remote mail alerting system to allow users, at a distance from their mail receptacle, to know precisely when mail has been delivered to the mail receptacle. The invention will now be described with reference to the several Figures, where like reference numerals represent like components or features throughout the various views.

Figure 2:
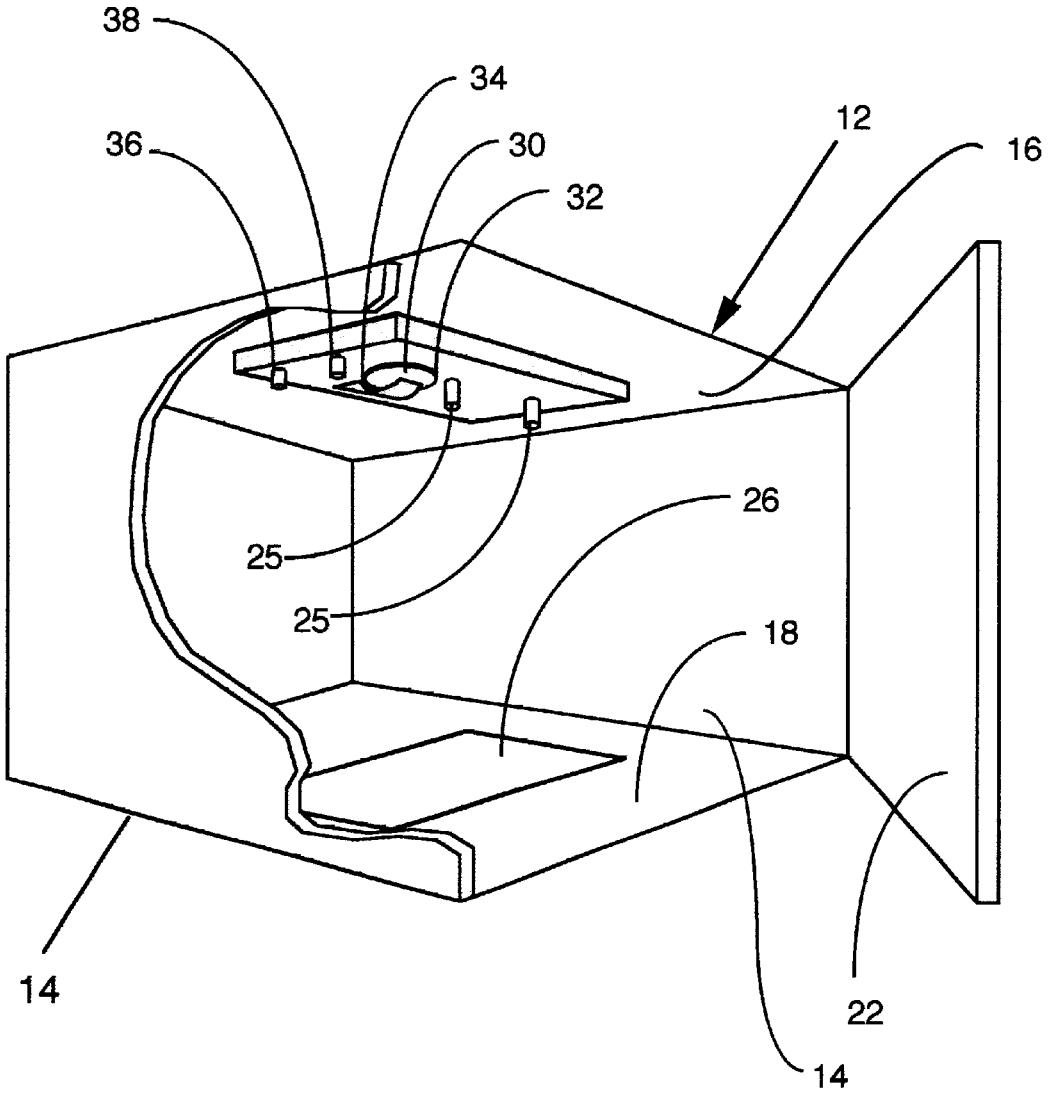
FIG. 2 is a perspective view, with parts removed, showing a remote mail receptacle mounting a portable battery, intermittantly operable, radio transceiver used for detecting the presense of mail in accordance with the system hereof.

Turning now to FIG. 1, there is illustrated a schematic representation of the system 10 of this invention, where the respective components are illustrated pictorially. FIG. 2 is a perspective view showing an exemplary mail receptacle 12, where said receptacle features a pair of side walls 14, a top wall 16, and a bottom wall or floor 18. The receptacle 12 further includes a rear wall 20, or opening for postal employees to access the receptacle. Opposite the rear wall or opening is a hinged door 22 which is normally locked and accessible only to the user. Such a receptacle is typical of those that may be found in a U.S. Post Office facility. A conventional mail receptacle, found at commercial mail facilities, apartment and condo complexes has only the single hinged opening. In either case, the mail receptacle 12 is secure to the user and/or authorized persons.

Returning to the illustration of FIG. 2, within the receptacle is mounted a battery powered, intermittently operable, radio transceiver 24, preferably fixed to the top wall 16, and an infrared reflector membrane 26, on the opposing or bottom wall 18. The radio transceiver 24 preferably features a pair of laser sources 25 emitting infrared light beams. If a single light beam is used it is vertically mounted so as to "read" itself when reflected off the membrane 26. However, with a preferred arrangement of two beams, the two beams are in a converging relationship so that one beam reads the reflected beam of the other originating beam. When the beam or beams read themselves, this is an indication of a "no-mail" mode. However, when the emitting beam(s) are interrupted, i.e. no reflection, this represents a "mail-presence" mode.

Since the radio transceiver 24 has no electrical power network, a portable DC battery 30 is positioned in slot 32 and held by spring clip 34. In order to minimize unnecessary drain on battery 30, the radio transceiver 24, when activated, emits an intermittent rather than constant signal. Further, to ensure a workable system with an operable battery, a test activation LED 36 with a test activation button 38 may be provided to test the battery 30. Further, since in many situations the mail receptacle 12, incorporating the system hereof, will be in close proximity, or even adjacent to other mail receptacles, it is necessary to assign an individual or unique code to ensure privacy. In this regard, the radio transceiver 24 may be provided with a frequency scanner, not illustrated, as known in the art. Specifically, in the initial setup of the system, the test activation button 38 may be depressed for a period of about five seconds, whereby the scanner will read all comparable systems in close proximity to the mail receptacle in question and select an individual code operable only for the desired mail receptacle. Alternately, an individual code could be assigned by the manufacturer.

Figure 3:
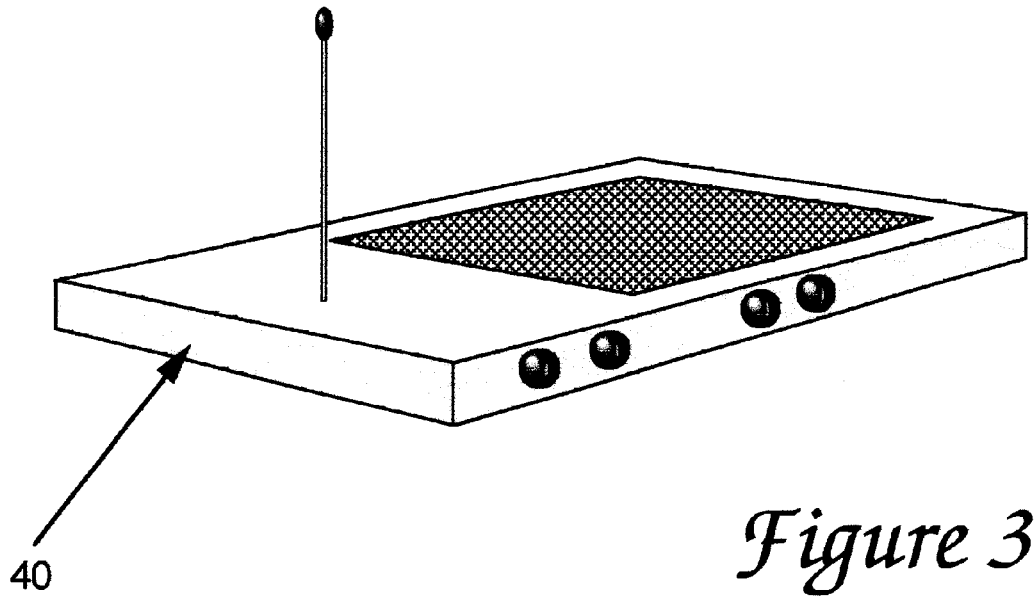
FIGS. 3 and 4 are perspective views of two versions of powered radio frequency polling transceiver polling relays, components or use in the system of this invention.
Figure 4:
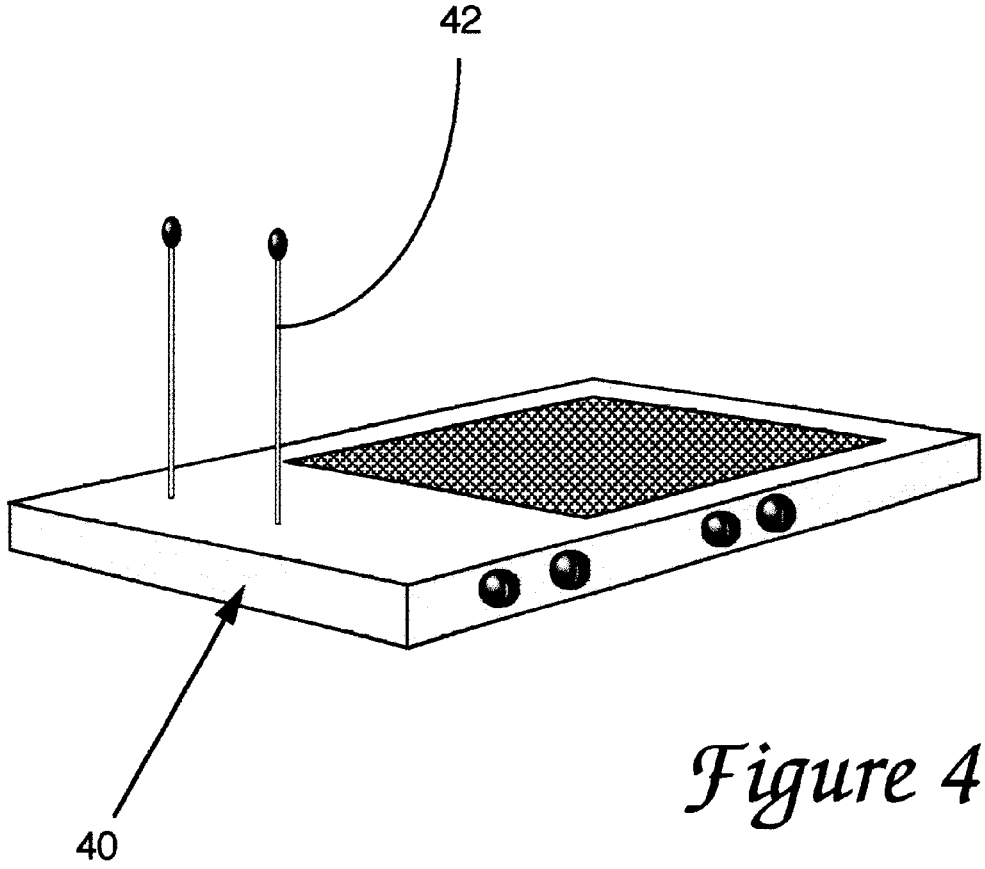

In operation, the radio transceiver 24 operates at timed intervals, if the at least one beam of laser sources 25 reads itself, or that of another reflected beam, a condition of no-mail, no signal will be transmitted. However, with an interrupted beam (a condition of mail being present), a signal of the individual code is transmitted to a powered radio frequency signal of the individual code is transmitted to a powered radio frequency polling transceiver relay 40, where two versions are illustrated in FIGS. 3 and 4. A particular advantage of the system of this invention is its use with multiple mail receptacles, such as found in apartment and condo complexes, and illustrated in the upper left comer of FIG. 1. With such multiple mail receptacles, where all or a number of the individual mail receptacles are equipped by the system hereof, a single powered radio frequency polling transceiver relay 40 is used for all the individual mail receptacles 12. The relay 40 has a memory chip, as known in the art, and operates in a scanning mode to detect and store signals from the plural radio transceivers 24. The relay 40 actually scans all operable radio transceivers 24 within its zone. Since the signal generated by the radio transceiver 24 may have a limited range, the polling transceiver relay 40 is mounted within said limited range. Further, said polling transceiver relay may be powered by AC or DC electrical sources or by solar power, and includes a memory chip, as noted above, to store a signal for later relay. FIG. 3 illustrates a first embodiment of a polling transceiver relay 40 that is not equipped to handle cellular transmissions, while FIG. 4 shows such relay 40 having an antenna 42 to broaden its applicability, and is hard wired to a telephone link for cellular and pager communication, as later described.

A final link or links to the system of this invention are the selected means to receive the signal from the radio frequency polling transceiver relay 40. Such means may consist of base transceiver 44 in a home, apartment or condo, for example, a vehicle radio transceiver 46, a pager or radio transceiver 48, or a cellular phone 50.

While the invention has been described relative to a preferred embodiment, it is recognized that variations, modifications, and changes may be made therein without departing from the spirit and scope of the invention. Accordingly, no limitation is intended to be imposed thereon except as set forth in the following claims.

What is claimed is:

1. In a communication system for the detection of mail delivered to a remote closed mail receptacle, where said mail receptacle comprises plural separate mail receptacles in close proximity to one another and each said separate mail receptacle is accessible to a user thereof, where each said separate receptacle includes at least a pair of opposing walls with means mounted therein for detecting the presence of mail, the improvement comprising in combination therewith the provision of a.) a portable battery, intermittently operable, radio transceiver mounted on one of each said opposing wall, including at least one infrared light beam directed toward the second of each said opposing wall, and a beam reflector membrane on each said second opposing wall, whereby a reflected said beam from said membrane represents a "no-mail" mode, and an interrupted said beam represents a "mail- present" mode;

b.) a powered radio frequency polling transceiver relay in communication with said intermittently operable, radio transceiver for detecting said "mail-present" mode in each said separate mail receptacle, whereby said radio frequency polling transceiver is a single unit scanning all said separate mail receptacles and operable to receive and store said individual codes from each said separate mail receptacle and is further programmed with an individual code specific to said intermittently operable, radio transceiver, and memory means to store receipt of transmission of said individual code for each said separate mail receptacle; and, c.) at least one radio transceiver operable to read said individual code through said polling transceiver, whereby delivered mail may be detected in each said remote, closed separate mail receptacle.

2. The mail alert communication system according to claim 1, wherein there are a pair of infrared light beams in a converging relationship toward said beam reflector membrane within each said seperate mail receptacle.

3. The mail alert communication system according to claim 1, wherein each said separate mail receptacle includes a top and bottom wall, and said intermittently operable, radio transceiver is mounted on said top wall and said beam reflector membrane is mounted on said bottom wall.

4. The mail alert communication system according to claim 1, wherein said powered radio frequency polling transceiver relay is mounted in a fixed position within a prescribed distance to said intermittently operable, radio transceiver.

5. The mail alert communication system according to claim 1, including means for testing the viability of the battery of said intermittently operable, radio transceiver.

6. The mail alert communication system according to claim 1, wherein said intermittently operable, radio transceiver includes a scanner means operable to scan comparable systems to read the operating codes of said comparable systems, and to program said system with said individual code unique from said operating codes.

7. The mail alert communication system according to claim 1, wherein the power source for said radio frequency polling transceiver relay is powered by a source selected from the group consisting of AC electricity, DC electricity, and solar power.

8. The mail alert communication system according to claim 1, wherein said at least one radio transceiver is a mobile unit selected from the group consisting of an automobile mounted unit, pager, and cellular phone.

9. The mail alert communication system according to claim 1, wherein there is at least one said radio transceiver associated with each said mail, receptacle, and that at least one said associated radio transceiver is operable only with its assigned said individual code.

* * * * *